US005236032A

United States Patent [19]

Nukami et al.

[11] Patent Number: 5,236,032

[45] Date of Patent: Aug. 17, 1993

[54] METHOD OF MANUFACTURE OF METAL COMPOSITE MATERIAL INCLUDING INTERMETALLIC COMPOUNDS WITH NO MICROPORES

[75] Inventors: Tetsuya Nukami, Toyota; Tetsuya Suganuma, Nagoya; Atsuo Tanaka, Toyota; Jun Ohkijima, Toyota; Yoshiaki Kajikawa, Toyota; Masahiro Kubo, Toyota, all of Japan

[73] Assignee: Toyota Jidosha Kabushiki Kaisha, Toyota, Japan

[21] Appl. No.: 802,716

[22] Filed: Dec. 6, 1991

Related U.S. Application Data

[63] Continuation of Ser. No. 544,962, Jun. 28, 1990, abandoned.

[30] Foreign Application Priority Data

| | | | |
|---|---|---|---|
| Jul. 10, 1989 | [JP] | Japan | 1-177721 |
| Sep. 20, 1989 | [JP] | Japan | 1-244158 |
| Oct. 30, 1989 | [JP] | Japan | 1-282250 |

[51] Int. Cl.[5] ..... B22D 19/14

[52] U.S. Cl. ..... 164/98; 164/91; 164/100

[58] Field of Search ..... 164/76.1, 91, 97, 98, 164/100, 101, 102, 103, 104; 75/228; 419/2, 27

[56] References Cited

U.S. PATENT DOCUMENTS

| | | | |
|---|---|---|---|
| 2,884,687 | 5/1959 | Thomson | 75/228 |
| 4,331,477 | 5/1982 | Kubo | 75/228 |
| 4,432,935 | 2/1984 | Kubo | 419/2 |
| 4,708,847 | 11/1987 | Donomoto | 420/129 |
| 4,739,817 | 4/1988 | Hamajima | 164/97 |
| 4,751,048 | 6/1988 | Christodoulou | 420/129 |
| 4,828,008 | 5/1989 | White et al. | 164/66.1 |
| 4,871,008 | 10/1989 | Dwivedi | 164/131 |
| 4,889,774 | 12/1989 | Fukizawa et al. | 428/614 |
| 4,916,030 | 4/1990 | Christodoulou | 428/614 |
| 4,935,055 | 6/1990 | Aghajanian | 164/97 |
| 5,000,246 | 3/1991 | Dwivedi | 164/97 |
| 5,020,584 | 6/1991 | Aghajanian | 164/101 |

FOREIGN PATENT DOCUMENTS

| | | | |
|---|---|---|---|
| 0133191 | 2/1985 | European Pat. Off. . | |
| 0340957 | 11/1989 | European Pat. Off. . | |
| 1037894 | 9/1953 | France . | |
| 49-42504 | 4/1974 | Japan . | |
| 50-109904 | 8/1975 | Japan . | |
| 52-28433 | 3/1977 | Japan . | |
| 59-500973 | 5/1984 | Japan . | |
| 60-9568 | 1/1985 | Japan | 164/97 |
| 61-48541 | 3/1986 | Japan | 164/97 |
| 61-295344 | 12/1986 | Japan . | |
| 1320003 | 6/1987 | U.S.S.R. | 164/97 |
| 2156718 | 10/1985 | United Kingdom . | |
| WO81/03295 | 11/1981 | World Int. Prop. O. . | |

OTHER PUBLICATIONS

Abstract of Jap. Publ. No. 57-31466, Feb. 19, 1982.
Abstract of Jap. Publ. No. 61-165265, Jul. 25, 1986.
Abstract of Jap. Publ. No. 57-169036, Oct. 18, 1982.
Abstract of Jap. Publ. No. 57-169037, Oct. 18, 1982.
Journal of Materials Science Letters 4 (1985) 385-388: "Preparation of Al-$Al_2O_3$-MgO Cast Particulate Composites Using MgO Coating Technique".

*Primary Examiner*—Mark Rosenbaum
*Assistant Examiner*—Rex E. Pelto
*Attorney, Agent, or Firm*—Kenyon & Kenyon

[57] ABSTRACT

A metal matrix composite material having uniformly dispersed intermetallic compounds and no micropores is manufactured by forming a porous preform including 60% to 80% by volume fine fragments essentially made of aluminum, 1% to 10% by volume fine fragments essentially made of nickel, copper or both, and 1% to 10% by volume fine fragments essentially made of titanium so that these fine fragments occupy in total 62% to 95% by volume of said preform, and at least a part of the preform is contacted with a melt of a matrix metal selected from aluminum, aluminum alloy, magnesium and magnesium alloy, so that the porous preform is infiltrated with the melt under no substantial application of pressure to the melt.

8 Claims, 1 Drawing Sheet

METHOD OF MANUFACTURE OF METAL COMPOSITE MATERIAL INCLUDING INTERMETALLIC COMPOUNDS WITH NO MICROPORES

This application is a continuation of application Ser. No. 07/544,962, filed Jun. 28, 1990 now abandoned.

BACKGROUND OF THE INVENTION

1. Field of the Invention

The present invention relates to a composite material, and more particularly, to a method of manufacture of a metal matrix composite material having high integrity of microstructure available by high affinity between materials to compose the composite material and generation of intermetallic compounds therein.

2. Description of the Prior Art

In U.S. patent application Ser. No. 07/343,508 now U.S. patent application Ser. No. 07/646,460 assigned to the same assignee as the present application it has been proposed to manufacture a metal matrix composite material in which aluminum, aluminum alloy, magnesium or magnesium alloy forming a base matrix is reinforced by micro reinforcing elements such as short fibers, whisker, particles or mixture of these made of alumina, carbon silicate, nitrogen silicate or the like, by first forming a porous preform from such micro reinforcing elements, and then infiltrating the porous preform with a melt of the matrix material, wherein the novel concept resides in that a third powder material is incorporated as mixed in the reinforcing micro elements in the process of forming the porous preform, said third material being metal such as Ni, Fe, Co, Cr, Mn, Cu, Ag, Si, Mg, Al, Zn, Sn, Ti or an alloy or alloys of these metals when the matrix metal is Al or Al alloy, said third material being metal such as Ni, Cr, Ag, Al, Zn, Sn, Pb or alloy or alloys of these metals when the matrix metal is Mg Mg alloy, or said third material being oxide of metal such as W, Mo, Pb, Bi, V, Cu, Ni, Co, Sn, Mn, B, Cr, Mg Al or mixture of these when the matrix metal is Al, Al alloy, Mg or Mg alloy.

According to this method of manufacture, the third powder material expedites the infiltration of the molten matrix metal into the interstices of the porous preform not only by the good affinity or wettability of the third material itself with the molten matrix metal but also by increased fluidization of the molten matrix metal due to the heat generated by the reaction between the third powder material and the molten matrix metal.

In various experimental researches on this method, however, it was found that under certain manufacturing conditions there were formed micropores in the composite material. For example, when a composite material was manufactured by forming a preform consisting of 5% by volume SiC particles (10 microns average particle diameter), 30% by volume aluminum alloy powder (Al-12% Si, 40 microns average particle diameter) and 30% by volume pure copper powder (30 microns average particle diameter) and immersing the preform in a melt of aluminum alloy (JIS standard AC8A) at 575° C. for 15 seconds, inspection of its section under the optical microscope revealed micropores in the composite structure which are guessed to have been caused by imperfect wetting of the aluminum alloy.

SUMMARY OF THE INVENTION

In the process of various experimental researches to seek conditions to avoid the generation of such micropores it was found that when a porous preform is formed of 60% to 80% by volume aluminum or aluminum alloy, 1% to 10% by volume nickel, copper, nickel alloy or copper alloy and 1% to 10% by volume titanium or titanium alloy so that the total percent by volume of such fragments is 62% to 95%, and such preform is infiltrated with molten matrix metal such as aluminum, aluminum alloy, magnesium or magnesium alloy by at least a part of said preform being contacted with a melt of such matrix metal, a highly integrated metal matrix composite material having reinforcing nuclei made of intermetallic compounds and including no micropores is obtained with no application of pressure to the melt of the matrix metal.

Accordingly, it is a first object of the present invention to provide a method of manufacture of a metal matrix composite material having a highly integrated composite structure reinforced with nuclei of intermetallic compounds generated therein and including no micropores therein.

It is a second object of the present invention to provide a method of manufacture of a composite material in which a conventional reinforcing material such as fibers, whisker or particles is in tight contact with a matrix material which itself is further reinforced with nuclei of intermetallic compound generated therein so that no voids are left between the reinforcing material and the matrix as well as in the body of the matrix.

The above-mentioned first object is accomplished according to the present invention by a method of manufacture of a metal matrix composite material comprising the steps of forming a porous preform including 60% to 80% by volume fine fragments essentially made of aluminum, 1% to 10% by volume fine fragments essentially made of nickel, copper or both, and 1% to 10% by volume fine fragments essentially made of titanium so that these fine fragments occupy in total 62% to 95% by volume of said preform, and contacting at least a part of said preform with a melt of a matrix metal selected from aluminum, aluminum alloy, magnesium and magnesium alloy, thereby infiltrating said porous preform with said melt under no substantial application of pressure to said melt.

Further, the above-mentioned second object is accomplished according to the present invention by that said preform is formed further to include dispersed reinforcing material.

Since the fine fragments essentially made of aluminum such as pure aluminum or aluminum alloy have excellent affinity to the melt of aluminum, aluminum alloy, magnesium or magnesium alloy, while since the fine fragments essentially made of nickel, copper or both such as pure nickel, pure copper, nickel alloy or copper alloy have low tendency to form oxides, these two kinds of fine fragments cooperate to provide excellent wetting for the melt of aluminum, aluminum alloy, magnesium or magnesium alloy in contacting with the fragments of pure aluminum or aluminum alloy while protecting surfaces of the fine fragments of pure aluminum or aluminum alloy from forming oxide layer. Further, when a part of the preform is heated by contact with the melt of matrix metal, the aluminum in the fine fragments of pure aluminum or aluminum alloy and the aluminum or magnesium in the melt of matrix metal reacts with the nickel or copper in the fine fragments of pure nickel, pure copper, nickel alloy or copper alloy so that intermetallic compounds are produced with generation of heat which fuses those fine fragments of pure aluminum or aluminum alloy and pure nickel, nickel alloy, pure copper or copper alloy.

On the other hand, according to such generation of heat, the titanium in the fine fragments of pure titanium or titanium alloy which is highly reactive with nitrogen and oxygen at elevated temperature absorbs air existing in the interstices of the preform so as to change it into volumeless liquid nitrides and oxides, thereby expediting intimate contact of the fine fragments of aluminum, etc with the melt of aluminum, etc.

Under such circumstances, when the volume proportion of the fine fragments of pure aluminum or aluminum alloy is selected to be 60% to 80% so as to leave a relatively low ratio of cavity in the preform, the fine fragments of pure nickel, pure copper, nickel alloy or copper alloy and the fine fragments of pure titanium or titanium alloy at such ratio as 1% to 10% by volume operate most effectively in protecting the fine fragments of pure aluminum or aluminum alloy from oxidization while decreasing the volume of air remaining in the spaces between the fine fragments of aluminum, etc. so that the melt of aluminum, etc can easily enter the spaces between such fine fragments.

According to the present invention, a satisfactory composite material is available if the temperature of the melt of matrix metal is, expressing the melting point of the matrix metal by T C°, in a range of the temperature for coexistence of liquid and solid such as T–T+50° C. In this case, however, it is desirable that the solid phase proportion of the melt is not more than 70%, particularly not more than 50%.

The fine fragments of metals used in the present invention may be in the form of powder, short fibers or whisker, and it is desirable that their sizes are, in the case of powder, an average particle diameter of 1 to 500 microns, particularly 3 to 200 microns, and in the case of short fibers or whisker, an average fiber diameter of 0.1 micron to 1 mm, particularly 1 to 200 microns and an average fiber length of 1 micron to 10 mm, particularly 1 to 200 microns.

Further, the reinforcing material used in the present invention may be in the form of short fibers, whisker or particles, and it is desirable that their sizes are, in the case of short fibers or whisker, an average fiber diameter of 0.1 to 20 microns, particularly 0.3 to 10 microns and an average fiber length of 5 microns to 10 mm, particularly 10 microns to 3 mm, and in the case of particles, an average particle diameter of 0.1 to 100 microns, particularly 1 to 30 microns.

It is desirable that the content of nickel in the nickel alloy when it is used in the present invention is at least 50% by weight, particularly more than 80% by weight, and, although any elements other than nickel, excepting inevitable impurities, may be included, they are particularly silver, aluminum, boron, cobalt, chromium, copper, iron, magnesium, manganese, molybdenum, lead, silicon, tin, tantalum, titanium, vanadium, zinc and zirconium.

Similarly, it is desirable that the content of copper in the copper alloy when it is used in the present invention is at least 50% by weight, particularly more than 80% by weight, and, although any elements other than copper, excepting inevitable impurities, may be included, they are particularly silver, aluminum, boron, cobalt, iron, magnesium, manganese, nickel, lead, silicon, tin, tantalum, titanium, vanadium, zirconium and zinc.

Similarly, it is desirable that the content of titanium in the titanium alloy when it is used in the present invention is at least 50% by weight, particularly more than 80% by weight, and, although any elements other than titanium, excepting inevitable impurities, may be included, they are particularly aluminum, vanadium, tin, iron, copper, manganese, molybdenum, zirconium, chromium, silicon, and boron.

BRIEF DESCRIPTION OF THE DRAWINGS

In the accompanying drawings.

DESCRIPTION OF THE PREFERRED EMBODIMENTS

The present invention will now be described in detail with respect to several preferred embodiments with reference to the accompanying drawings.

Embodiment 1

Figure 1:
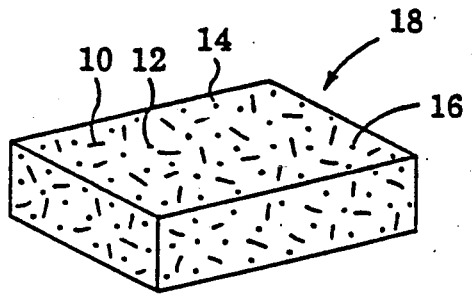
FIG. 1 is a perspective view of a preform comprising alumina-silica short fibers, aluminum alloy powder, pure titanium powder and pure nickel powder.

Alumina-silica short fibers having 3 microns average fiber diameter and 1.5 mm average fiber length (manufactured by Isolite Kogyo KK), aluminum alloy powder (JIS standard AC8A) having 150 microns average particle diameter or aluminum alloy powder (JIS standard AC7A) having 100 microns average particle diameter, pure titanium powder having 20 microns average particle diameter, and pure nickel powder having 20 microns average particle diameter were mixed in various proportions and subjected to compression forming to produce preforms such as shown in FIG. 1 having 45×25×10 mm dimensions and including the alumina-silica short fibers 10 at 0%, 5%, 10%, 15% or 20% by volume, the aluminum alloy powder 12 at 40%, 50%, 60%, 70% or 80% by volume, the pure titanium powder 14 at 0%, 1%, 5%, 10% or 15% by volume, and the pure nickel powder 16 at 0%, 1%, 3%, 5%, 7%, 10% or 15% by volume, respectively, except such cases that the total volume proportion would exceed 95%.

Figure 2:
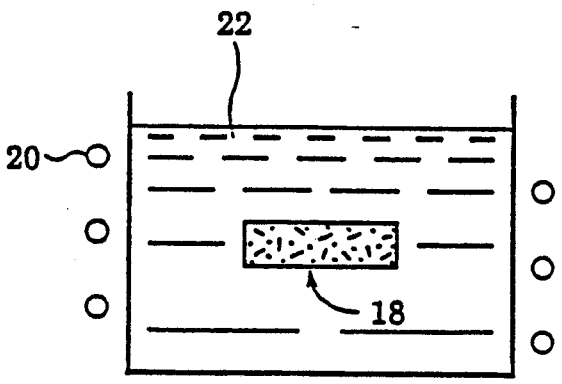
FIG. 2 is a sectional view schematically showing the preform shown in FIG. 1 immersed in the molten aluminum alloy.

Next, as shown in FIG. 2, each preform 18 was immersed in a melt 22 of aluminum alloy (JIS standard AC8A) maintained at 570 C.° by a heater 20, was held there for 10 seconds, and then was removed from the melt, and then the molten metal infiltrated in the preform was solidified without further treatment.

Next, each composite material thus formed was sectioned, and by observation of the section, the penetration of the melt was investigated. The results are shown in Table 1 and Table 2 in which <DOUBLE CIRCLE> indicates that there were no micropores at all, <CIRCLE> indicates that there were an extremely small quantity of micropores, and <TRIANGLE> indicates that there were a small quantity of micropores. Table 1 shows the results when the volume proportion of the alumina-silica short fibers was 0%, 5%, 10%, 15% or 20%, and the volume proportion of the pure nickel powder was 0% or 15%, and Table 2 shows the results when the volume proportion of the alumina-silica short fibers was 0%, 5%, 10%, 15% or 20%, and the volume proportion of the pure nickel powder was 1%, 3%, 5%, 7% or 10%.

From Table 1 and Table 2 it will be seen that irrespective of the composition of the aluminum alloy powder, it is desirable that the volume proportion of the aluminum alloy powder is between 60% and 80%, and the volume proportions of the pure nickel powder and the pure titanium powder are between 1% and 10%, respectively.

Further, as a result of X-ray analysis of sections of those composite materials indicated by <DOUBLE CIRCLE> in Table 2, it was confirmed that the pure nickel powder had reacted almost completely with aluminum so as to produce fine intermetallic compounds such as $NiAl_3$ and NiAl, that in the case where the volume proportion of the alumina-silica short fibers was 0% the aluminum alloy matrix was compositely reinforced by these fine intermetallic compounds, and that in the case where the volume proportion of the alumina-silica short fibers was between 5% and 20% the aluminum alloy matrix was compositely reinforced not only by the alumina-silica short fibers but also by these fine intermetallic compounds.

Embodiment 2

5% by volume silicon carbide whisker (manufactured by Tokai Carbon KK, having 0.3 micron average fiber diameter and 100 microns average fiber length) as a reinforcing material, 70% by volume pure aluminum powder (50 microns average particle diameter), 5% by volume pure nickel powder (30 microns average particle diameter) and 5% by volume pure titanium powder (30 microns average particle diameter) were mixed and subjected to compression forming to produce four preforms, and composite materials were manufactured in the same manner and under the same conditions as in Embodiment 1, except that the melts of matrix metal were aluminum alloy (JIS standard A2024) at 550 C.°, 600 C.°, 650 C.°, 700 C.° and 750 C.°, and by observation of sections of these materials, the penetration of the melt was investigated.

As a result, it was confirmed that whatever the temperature of the melt of matrix metal was, satisfactory composite materials were formed with no the generation of micropores.

Embodiment 3

10% by volume silicon carbide particles (manufactured by Showa Denko KK, 30 microns average particle diameter) as a reinforcing material, 60% by volume aluminum alloy powder (JIS standard A2024, 150 microns average particle diameter), 8% by volume pure nickel powder (30 microns average particle diameter), and 3% by volume pure titanium powder (30 microns average particle diameter) were mixed and subjected to compression forming to produce preforms, and composite materials were manufactured in the same manner and under the same conditions as in Embodiment 1, except that the melt of matrix metal melt was a semi-molten aluminum alloy (Al-30% Cu) at a temperature of approximately 550 C.°, and the immersion time of the preform in the melt was 30 seconds, and then by observation of sections of this material, the penetration of the melt was investigated.

As a result, it was confirmed that also in this embodiment, satisfactory composite materials including no micropores were formed.

Further, as a result of X-ray analysis of sections of the composite materials formed in Embodiments 2 and 3, it was confirmed that the pure nickel powder had reacted almost completely with aluminum so as to produce fine intermetallic compounds such as $NiAl_3$ and NiAl, and that the aluminum alloy matrix was compositely reinforced not only by the reinforcing material but also by these intermetallic compounds.

Embodiment 4

15% by volume alumina short fibers ("Safil RF" manufactured by ICI, 3 microns average fiber diameter, 1 mm average fiber length) as a reinforcing material, 65% by volume aluminum alloy fibers (manufactured by Aisin Seiki KK, Al-5% Mg, 60 microns average fiber diameter, 3 mm average fiber length), 5% by volume pure nickel fibers (manufactured by Tokyo Seiko KK, 20 microns average fiber diameter, 1 mm average fiber length), and 10% by volume pure titanium fibers (manufactured by Tokyo Seiko KK, 20 microns average fiber diameter, 1 mm average fiber length) were mixed and subjected to compression forming to produce a preform.

Then, this preform was disposed within a die (JIS standard No. 10) at 400 C.°, molten magnesium alloy (SAE standard AZ91) at 650 C.° was poured into this die, and the preform infiltrated with the molten magnesium alloy was cooled to room temperature under supply of sulfur hexafluoride gas over the surface of the melt to prevent oxidation of the magnesium alloy.

Then, the composite material thus formed was sectioned, and by observation of sections of this material, the penetration of the melt was investigated. As a result, it was confirmed that also in this embodiment a satisfactory composite material including no micropores was formed.

Further, as a result of X-ray analysis of sections of the composite material formed in this embodiment, it was confirmed that the matrix at a central portion was an aluminum alloy while the matrix at peripheral portions was a magnesium alloy, that the nickel fibers had reacted with aluminum so as to produce intermetallic compounds such as $NiAl_3$ and NiAl, that particularly at peripheral portions the pure nickel fibers had reacted also with magnesium so as to produce intermetallic compounds such as $Mg_2Ni$ and $MgNi_2$, such intermetallic compounds being higher in density toward outer peripheral portions, and the matrix was compositely reinforced not only by the reinforcing material but also by these intermetallic compounds.

Further, when a composite material was produced in the same way except that the nickel fibers were replaced by the nickel powder used in Embodiment 3 or the molten magnesium alloy was replaced by molten pure magnesium at 680 C.°, in both cases satisfactory composite materials including no micropores were formed.

Embodiment 5

72% by volume pure aluminum powder (50 microns average particle diameter), 6% by volume pure nickel powder (30 microns average particle diameter), and 5% by volume pure titanium powder (30 microns average particle diameter) were mixed and subjected to compression forming to produce preforms, and composite materials were manufactured in the same manner and under the same conditions as in Embodiment 1, except that the melt of matrix metal was an aluminum alloy (JIS standard A2024) at 650 C.°.

Then, by observation of sections of the materials thus formed, the penetration of the melt was investigated, and as a result, it was confirmed that satisfactory composite materials including no micropores were formed. Further, as a result of X-ray analysis of sections of the composite materials, it was confirmed that the matrix at a central portion and peripheral portions were substantially pure aluminum and aluminum alloy, respectively, that the pure nickel powder had reacted almost completely with aluminum so as to produce intermetallic compounds such as $NiAl_3$ and NiAl, and that the matrix was compositely reinforced by these intermetallic compounds.

When in this embodiment the melt of matrix metal was replaced by a pure magnesium melt at 680 C.°, the composite material formed in the same way had again a satisfactory composite structure including no micropores.

Embodiment 6

Composite materials were formed in the same manner and under the same conditions as in Embodiment 1, except in that the pure nickel powder was replaced by pure copper powder having 30 microns average particle diameter, and by investigation of sections of the composite materials thus formed, the penetration of the melt was investigated.

The results obtained were similar to those obtained in Embodiment 1. In other words, regardless of the composition of the aluminum alloy powder, it is desirable that the volume proportion of the aluminum alloy powder is between 60 and 80%, and the volume proportion of each of the pure copper powder and the pure titanium powder is between 1 and 10%, respectively.

Further, as a result of X-ray analysis of sections of the composite materials thus, it was confirmed that the pure copper powder had reacted almost completely with aluminum so as to form intermetallic compounds such as $CuAl_2$, that when the volume proportion of the alumina-silica short fibers was 0%, the aluminum alloy matrix was compositely reinforced by these intermetallic compounds, and that when the volume proportion of the alumina-silica short fibers was from 5% to 20%, the aluminum alloy matrix was compositely reinforced not only by the alumina-silica short fibers but also by the intermetallic compounds.

Embodiment 7

Composite materials were formed in the same manner and under the same conditions as in Embodiment 2, except that the pure nickel powder was replaced by pure copper powder having 30 microns average particle diameter.

As a result, it was confirmed that at all temperatures of the melt of matrix metal satisfactory composite materials were obtained with no generation of micropores.

Embodiment 8

Composite materials were manufactured in the same manner and under the same conditions as in Embodiment 3, except that the pure nickel powder was replaced by pure copper powder having 30 microns average particle diameter.

As a result, it was confirmed that in this embodiment also satisfactory composite materials including no micropores were formed.

As a result of X-ray analysis of sections of the composite materials formed in Embodiment 7 and Embodiment 8, it was confirmed that the pure copper powder had reacted almost completely with aluminum so as to form intermetallic compounds such as $CuAl_2$, and that the aluminum alloy of the matrix was compositely reinforced not only by the reinforcing material but also by these intermetallic compounds.

Embodiment 9

A composite material was manufactured in the same manner and under the same conditions as in Embodiment 4, except that the pure nickel fibers were replaced by pure copper fibers (manufactured by Tokyo Seiko KK, 20 microns average fiber diameter, and 1 mm average fiber length), and by observation of sections of the composite material thus formed, the penetration of the melt was investigated.

As a result, it was confirmed that also in this embodiment a satisfactory composite material including no micropores was formed.

Further, as a result of X-ray analysis of sections of the composite material thus formed, it was confirmed that a central portion of the matrix was aluminum alloy while peripheral portions of the matrix was magnesium, that the pure copper fibers had reacted with aluminum so as to form intermetallic compounds such as $CuAl_2$, that particularly in the peripheral portions the pure copper fibers had also reacted with the magnesium so as to form fine intermetallic compounds such as $MgCu_2$, and that the proportion of these intermetallic compounds was higher toward the peripheral portion. Thus it was confirmed that the matrix was compositely reinforced not only by the reinforcing material but also by these intermetallic compounds.

When in this embodiment the composite material was formed in the same manner except that the pure copper fibers were replaced by the pure copper powder used in Embodiment 8 or the melt of magnesium alloy was replaced by a melt of pure magnesium at 680°C., in both cases satisfactory composite materials including no micropores were obtained.

Embodiment 10

Composite materials were formed in the same manner and under the same conditions as in Embodiment 5, except that the pure nickel powder was replaced by pure copper powder having 30 microns average particle diameter.

Then, by examining sections of the composite materials thus formed, the penetration of the melt was investigated, and as a result it was confirmed that satisfactory composite materials including no micropores were formed. Further, as a result of X-ray analysis of sections of the composite materials, it was confirmed that the pure copper powder had reacted almost completely with aluminum so as to form intermetallic compounds such as $CuAl_2$, and that the matrix was compositely reinforced by these intermetallic compounds.

When in this embodiment composite materials were formed in the same manner except that the melt of matrix metal was replaced by a melt of pure magnesium at 680°C., satisfactory composite materials including no micropores were also obtained.

Embodiment 11

Alumina-silica short fibers having 3 microns average fiber diameter and 1.5 mm average fiber length (manufactured by Isolite KK), aluminum alloy powder (JIS Standard AC8A) having 150 microns average particle diameter or aluminum alloy powder (JIS Standard AC7A) having 100 microns average particle diameter, pure titanium powder having 30 microns average particle diameter, pure nickel powder having 30 microns average particle diameter, and pure copper powder having 30 microns average particle diameter were mixed in various proportions and subjected to compression forming to produce preforms having 45×25×10 mm dimensions and including the alumina-silica short fibers at 0%, 5%, 10%, 15% or 20% by volume, the aluminum alloy powder at 40%, 50%, 60%, 70% or 80% by volume, the pure titanium powder at 0%, 1%, 5%, 10% and 15% by volume, the pure copper powder at 0.5% by volume, and the pure nickel powder at 0.5% to 15% (in steps of 0.5%) by volume, respectively, except such cases that the total volume proportion would exceed 95%.

Moreover, preforms were prepared in the same manner as above to have 45×25×10 mm dimensions except that the volume proportion of nickel powder was 0.5% and the volume proportion of pure copper powder was 0.5% to 15% (in steps of 0.5%).

Then, composite materials were formed in the same manner and under the same conditions as in Embodiment 1, except that the above preforms were used, and by examination of sections thereof the penetration of the melt was investigated.

As a result, as in Embodiment 1, it was confirmed that regardless of the composition of the aluminum alloy powder, it was desirable for the volume proportion of the aluminum alloy powder to be between 60 and 80%, for the volume proportion of the pure nickel powder plus the pure copper powder to be between 1 and 10%, and for the volume proportion of the pure titanium powder to be between 1 and 10%.

Further, as a result of X-ray analysis of sections of the composite materials formed with the volume proportions of the aluminum alloy powder, the pure nickel powder plus the pure copper powder, and the pure titanium powder within the above described preferable ranges, it was confirmed that the pure nickel powder and the pure copper powder had reacted almost completely with aluminum so as to form intermetallic compounds such as $NiAl_3$ and NiAl and $CuAl_2$, respectively, and that in the case where the volume proportion of the alumina-silica short fibers was 0%, the matrix of aluminum alloy was compositely reinforced by these intermetallic compounds, and in the case where the volume proportion of alumina-silica short fibers was between 5 and 20%, the matrix of aluminum alloy was compositely reinforced not only by these alumina-silica short fibers but also by the intermetallic compounds.

Embodiment 12

Composite materials were formed in the same manner and under the same conditions as in Embodiment 2, except that the pure nickel powder was replaced by 2.5% by volume pure nickel powder (5 microns average particle diameter) and 2.5% by volume pure copper powder (30 microns average particle diameter).

As a result, it was confirmed that regardless of the temperature of the melt of matrix metal satisfactory composite materials including no micropores were formed.

Embodiment 13

Composite materials were manufactured in the same manner and under the same conditions as in Embodiment 3, except that the pure nickel powder was replaced by 3% by volume pure nickel powder (10 microns average particle diameter) and 3% by volume pure copper powder (20 microns average particle diameter).

As a result, it was confirmed that in this embodiment satisfactory composite materials including no micropores were also obtained.

As a result of X-ray analysis of sections of the composite materials formed in Embodiment 12 and embodiment 13, it was confirmed that the pure nickel powder and the pure copper powder had reacted almost completely with the aluminum so as to form intermetallic compounds such as $NiAl_3$ and $CuAl_2$, respectively, and that the matrix of aluminum alloy was compositely reinforced not only by the reinforcing material but also by these intermetallic compounds.

Embodiment 14

A composite material was manufactured in the same manner and under the same conditions as in Embodiment 4, except that the pure nickel fibers were replaced by 5% by volume pure nickel fibers (30 microns average fiber diameter and 3 mm average fiber length) and 5% by volume pure copper fibers (20 microns average fiber diameter and 1 mm average fiber length), and by examination of sections of the composite material thus formed, the penetration of the melt was investigated.

As a result, it was confirmed that in this embodiment a satisfactory composite material including no micropores was also formed.

As a result of X-ray analysis of sections of the composite material, it was confirmed that a central portion of the matrix was aluminum alloy while peripheral portions of the matrix was magnesium, that the pure nickel fibers and the pure copper fibers had reacted with aluminum so as to form intermetallic compounds such as $NiAl_3$ and $CuAl_2$, respectively, that particularly in the peripheral portions the pure nickel fibers and the pure copper fibers had reacted also with the magnesium so as to form intermetallic compounds such as $NiMg_2$ and $MgCu_2$, respectively, and that the matrix was compositely reinforced not only by the reinforcing material but also by these intermetallic compounds.

When in this embodiment a composite material formed in the same manner with the nickel fibers and the copper fibers being replaced respectively by the pure nickel powder and the pure copper powder used in Embodiment 13, or when the melt of magnesium alloy was also replaced by a melt of pure magnesium at 680°C., in both cases satisfactory composite materials including no micropores were formed.

Embodiment 15

Composite materials were formed in the same manner and under the same conditions as in Embodiment 3, except that the pure nickel powder was replaced by 4% by volume pure nickel powder (15 microns average particle diameter) and 4% by volume pure copper powder (25 microns average particle diameter).

Then, by observation of sections of the composite materials thus formed, the penetration of the melt was investigated, and as a result it was confirmed that satisfactory composite materials including no micropores were formed. Further, as a result of X-ray analysis of sections of the composite materials, it was confirmed that the pure nickel powder and the pure copper powder had reacted almost completely with aluminum so as to produce intermetallic compounds such as $NiAl_3$ and $CuAl_2$, respectively, and that the matrix was compositely reinforced not only by the reinforcing materials but also by these intermetallic compounds.

Embodiment 16

Composite materials were formed in the same manner and under the same conditions as in Embodiment 5, except that the pure nickel powder was replaced by 5% by volume pure nickel powder (15 microns average particle diameter) and 5% pure copper powder (25 microns average particle diameter).

Then, by observation of sections of the composite materials thus formed, the penetration of the melt was investigated, and as a result it was confirmed that satisfactory composite materials including no micropores were formed. Further, as a result of X-ray analysis of sections of the composite materials, it was confirmed that a central portion and peripheral portions of the matrix were substantially pure aluminum and aluminum alloy, respectively, that the pure nickel powder and the pure copper powder had reacted almost completely with aluminum so as to form intermetallic compounds such as $NiAl_3$ and $CuAl_2$, respectively, and that the matrix was compositely reinforced by these intermetallic compounds.

When in this embodiment the melt of matrix metal was replaced by a melt of pure magnesium at 680° C. and composite materials were formed in the same manner, satisfactory composite materials including no micropores were also obtained.

Although the fine fragments of some particular compositions were used in the various embodiments described above, in the present invention the fine fragments may have other compositions. The composition of the aluminum alloy may be, for example, JIS Standard AC7A, JIS Standard ADC12, JIS Standard ADT17, or 8% Al-3.5% Mg, and so forth, the composition of the nickel alloy may be, for example, Ni-50% Al, Ni-30% Cu, Ni-39.5% Cu-22.1% Fe, 8.8% B, and so forth, the composition of the copper alloy may be, for example, Cu-50% Al, Cu-29.6% Ni-22.1% Fe-8.8% B, and so forth, and particularly when the nickel alloy or the copper alloy is a nickel-copper alloy, the nickel and copper contents may have any proportions, and further, the titanium alloy may be, for example, Ti-1% B.

As will be clear from the above descriptions, according to the present invention the molten matrix metal satisfactorily infiltrates into the preform, and by the reaction of titanium with oxygen and nitrogen in the preform, air is substantially removed from the preform, and as a result an even more satisfactory composite material including no micropores is manufactured.

Further, according to the present invention, since the temperature of the molten matrix metal may be relatively low, and since the time duration for the preform to be in contact with the molten metal is shortened as compared with the case where no fragments of nickel, copper, nickel alloy, copper alloy, titanium or titanium alloy is included in the preform, a composite material can be manufactured at lower cost and at higher efficiency as compared with the above-mentioned prior proposal.

Although the present invention has been described in detail in terms of several embodiments, it will be clear to those skilled in the art that the present invention is not limited to these embodiments, and various other embodiments are possible within the scope of the present invention. For example, all or some of the fine fragments of nickel, nickel alloy, copper or copper alloy may be replaced by fine fragments of silver or silver alloy or fine fragments of gold or gold alloy.

TABLE 1

| | | VOLUME PROPORTION OF Ti POWDER (%) | | | | |
|---|---|---|---|---|---|---|
| | | 0 | 1 | 5 | 10 | 15 |
| VOLUME PROPORTION OF Al POWDER (%) | 40 | Δ | Δ | Δ | Δ | Δ |
| | 50 | ○ | ○ | ○ | ○ | ○ |
| | 60 | ○ | ○ | ○ | ○ | ○ |
| | 70 | ○ | ○ | ○ | ○ | ○ |
| | 80 | ○ | ○ | ○ | ○ | ○ |

TABLE 2

| | | VOLUME PROPORTION OF Ti POWDER (%) | | | | |
|---|---|---|---|---|---|---|
| | | 0 | 1 | 5 | 10 | 15 |
| VOLUME PROPORTION OF Al POWDER (%) | 40 | Δ | Δ | Δ | Δ | Δ |
| | 50 | ○ | ○ | ○ | ○ | ○ |
| | 60 | ○ | ◎ | ◎ | ◎ | ○ |
| | 70 | ○ | ◎ | ◎ | ◎ | ○ |
| | 80 | ○ | ◎ | ◎ | ◎ | ○ |

We claim:

1. A method of manufacture of a metal matrix composite material comprising the steps of forming an unreacted porous preform including 60% to 80% by volume fine fragments essentially made of aluminum or aluminum alloy, 1% to 10% by volume fine fragments essentially made of nickel, copper, nickel alloy or copper alloy, and 1% to 10% by volume fine fragments essentially made of titanium or titanium alloy by compression of a mixture of said fine fragments so that these fine fragments occupy in total 62% to 95% by volume of said preform, and contacting at least a part of said preform with a melt of a matrix metal selected from aluminum, aluminum alloy, magnesium and magnesium alloy, thereby infiltrating said porous preform with said melt under no substantial application of pressure to said melt.

2. A method of manufacture of a metal matrix composite material according to claim 1, wherein said preform is formed further to include dispersed reinforcing material.

3. A method of manufacture of a metal matrix composite material according to claim 1, wherein said fine fragments essentially made of nickel, copper, nickel alloy or copper alloy are essentially made of a nickel alloy having a nickel content of at least 50% by weight.

4. A method of manufacture of a metal matrix composite material according to claim 3, wherein said fine fragments essentially made of nickel, copper, nickel alloy or copper alloy are essentially made of a nickel alloy having a nickel content of more than 80% by weight.

5. A method of manufacture of a metal matrix composite material according to claim 1, wherein said fine fragments essentially made of nickel, copper, nickel alloy or copper alloy are essentially made of a copper alloy having a copper content of at least 50% by weight.

6. A method of manufacture of a metal matrix composite material according to claim 5, wherein said fragments essentially made of nickel, copper, nickel alloy or copper alloy are essentially made of a copper alloy having a copper content of more than 80% by weight.

7. A method of manufacture of a metal matrix composite material according to claim 1, wherein said fine fragments essentially made of titanium or titanium alloy are essentially made of a titanium alloy having a titanium content of at least 50% by weight.

8. A method of manufacture of a metal matrix composite material according to claim 7, wherein said fine fragments essentially made of titanium or titanium alloy are essentially made of a titanium alloy having a titanium content of more than 80% by weight.

* * * * *